US006935091B2

(12) United States Patent
Gamberini

(10) Patent No.: US 6,935,091 B2
(45) Date of Patent: Aug. 30, 2005

(54) METHOD AND APPARATUS FOR WRAPPING ARTICLES WITH A PACKAGING SHEET

(75) Inventor: Gianluigi Gamberini, Bologna (IT)

(73) Assignee: Techmatic S.r.l., Bologna (IT)

( * ) Notice: Subject to any disclaimer, the term of this patent is extended or adjusted under 35 U.S.C. 154(b) by 0 days.

(21) Appl. No.: 10/982,203

(22) Filed: Nov. 5, 2004

(65) Prior Publication Data

US 2005/0097865 A1 May 12, 2005

Related U.S. Application Data

(62) Division of application No. 10/703,204, filed on Nov. 6, 2003, now abandoned.

(51) Int. Cl.[7] ..... B65B 11/22

(52) U.S. Cl. ..... 53/466

(58) Field of Search ..... 53/461, 466, 48.6, 53/48.7, 48.8, 228, 229, 230, 231, 232

(56) References Cited

U.S. PATENT DOCUMENTS

| | | | | |
|---|---|---|---|---|
| 2,243,633 A * | 5/1941 | Jones | ..... | 53/466 |
| 3,899,865 A * | 8/1975 | Revaz | ..... | 53/234 |
| 5,647,190 A * | 7/1997 | Minarelli et al. | ..... | 53/466 |
| 6,381,920 B1 * | 5/2002 | Bailey et al. | ..... | 53/234 |

* cited by examiner

*Primary Examiner*—John Sipos
(74) *Attorney, Agent, or Firm*—William J. Sapone; Coleman Sudol Sapone PC

(57) ABSTRACT

The method envisages that groups of articles (2,22) to be packaged, arranged orderly with a lateral narrowed dimension oriented in the forward movement direction (A), are fed along a feeding line (1). Single packaging sheets (3) are carried beside the feeding line (1), in suitable phase relation with the forward movement of the articles (2,22). The groups of articles (2,22) are transferred crosswise to the feeding line (1), so as to hit the sheets (3) with the lateral narrow extension of the groups of articles (2,22) in order to fold the sheets (3). The folded edges of the sheets (3) are joined along the opposite side of the groups of articles (2,22), presenting a corresponding lateral narrow extension.

6 Claims, 5 Drawing Sheets

METHOD AND APPARATUS FOR WRAPPING ARTICLES WITH A PACKAGING SHEET

CROSS-REFERENCE TO RELATED APPLICATION

This application is a division of application Ser. No. 10/703,204, originally filed on Nov. 6, 2003 now abandoned.

TECHNICAL FIELD

The present invention relates to wrapping articles with a packaging sheet.

More precisely, the invention relates to a method and an apparatus for wrapping articles stacked in piles or in rolls by a film of plastic material, e.g. polyethylene.

BACKGROUND

It is known that consumption articles, such as rolls of toilet paper or kitchen towels are usually packaged in packs or groups by a film or plastic transparent material, e.g. polyethylene, polythene, polypropylene, etc.

At present, the articles are packaged by machines, which form groups of articles, usually in a loading or collecting tray, and which push the grouped articles upwards by means of a raising plate, against a sheet of plastic material, which is kept spread over the plate.

The group of articles is introduced into a space, which is formed by fixed walls and which those skilled in the art call a "hopper".

Thus, the sheet of plastic material wraps the upper surface of the so grouped articles.

In phase relation with the raising plate downward return movement, the sheet is tucked in against the lower surface of the group of articles by two movable horizontal plates.

Then, a conveyor, equipped with vertical arms, moves the group of articles wrapped with the sheet of plastic material toward a welding station, where the package is closed by welding the overlapped edges of the sheet of plastic material, on the lower surface of the grouped articles.

The above solution is undoubtedly complicated due to the necessity to foresee different changes of the groups of articles movement, which results in high construction costs.

Moreover, it is also obvious that each change of the direction requires a stop for a group of articles.

The time intervals necessary for different stops accumulate, due to a high number of packages being produced and consequently, the total stop time becomes significant.

In addition to the technical and production considerations presented previously, the currently used constructive solutions feature another drawback which lies in the closure welding, which must be made on one of the biggest surfaces of the packages or groups of packaged articles.

Considering its upward movement, the just formed group of articles hits the sheet of plastic packaging material with its larger surface and the sheet is tucked on the opposite surface by overlapping and welding the edges thereof.

This reduces the possibility to use the entire surface, limited by the welding, for printing commercial advertisements or other kinds of information.

SUMMARY OF THE INVENTION

The object of the present invention is to propose a method for wrapping articles, according to which the groups of articles move as linearly as possible and without changes of direction or stops necessary for this purpose.

Another object of the present invention is to propose an apparatus which carries out the above method, which is simple to construct and which is easily and rapidly adaptable to different sizes of articles to be packaged as well as of the ready packages, without the necessity to use a complicated structure, thus lowering the production costs.

A further object of the present invention is to propose a method and an apparatus which produce packages formed by groups of articles according to what has been presented previously, and which allow to leave completely free the two most extended surfaces of the packages or groups of packaged articles, so that these surfaces can be used for printing commercial advertisements or other information.

The above-mentioned objects are obtained in accordance with the present invention.

BRIEF DESCRIPTION OF THE DRAWINGS

The characteristic features of the present invention will be pointed out in the following description of a preferred, but not the only embodiment, with reference to the enclosed drawings, in which.

DETAILED DESCRIPTION OF THE INVENTION

Figure 1A:
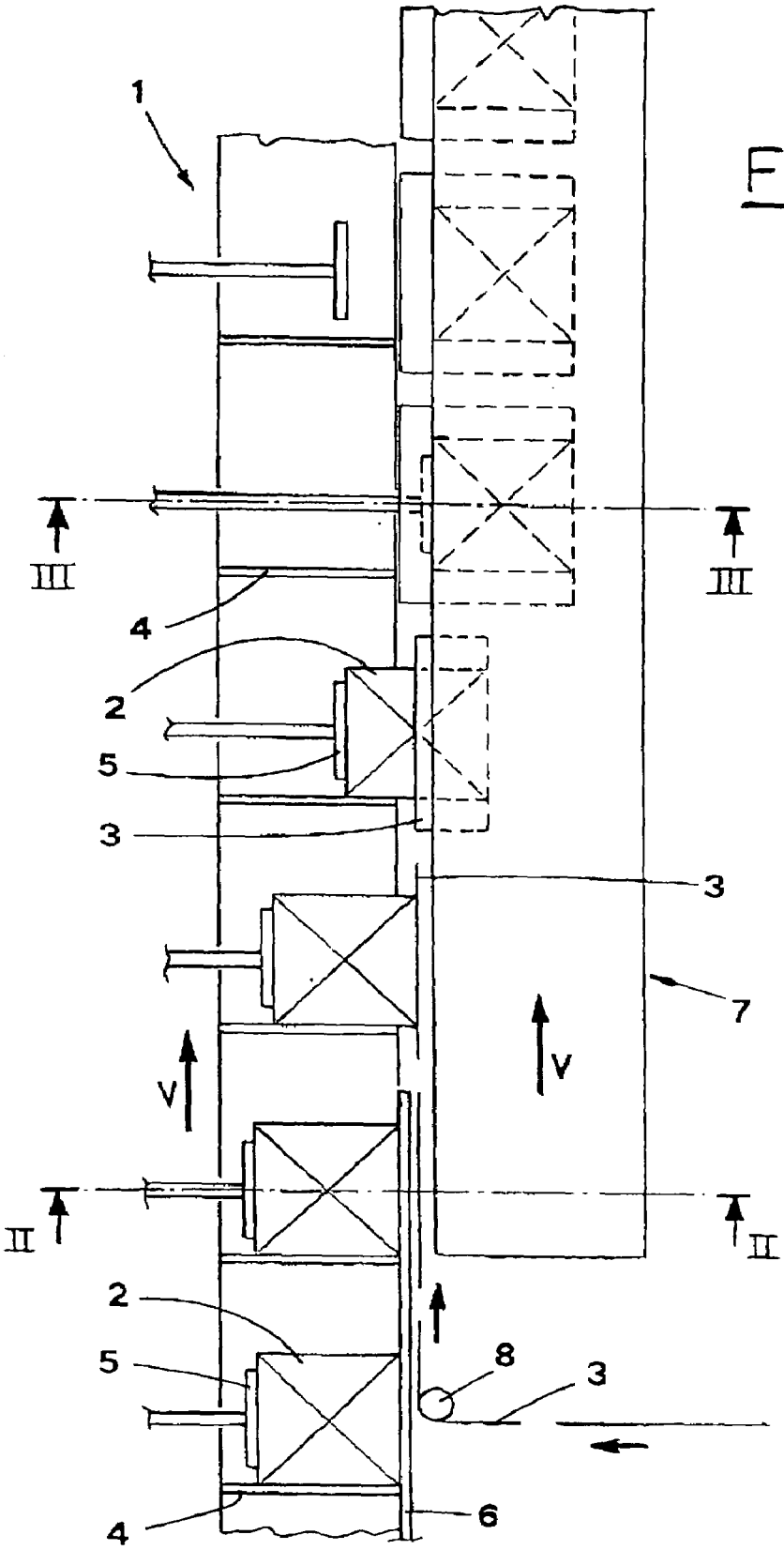
FIG. 1A is a partial, schematic top view of an apparatus for wrapping articles with a packaging sheet, taken in the region of the inlet area for the articles to be packaged.

With reference to the above figures, the reference numeral 1 indicates a feeding line for articles 2 to be wrapped with a packaging sheet 3.

The feeding line 1 is formed by e.g. a conveyor equipped with a series of bars 4 defining spaces, which receive the articles 2 to be packaged, already arranged in groups according known techniques.

Each space defined between the bars 4 is provided with related pusher members 5, which are aimed at transferring groups of articles 2 crosswise to the line 1.

The pusher members 5 are carried, according to known techniques, by conveying means, not shown, arranged beside the feeding line 1.

Figure 2:
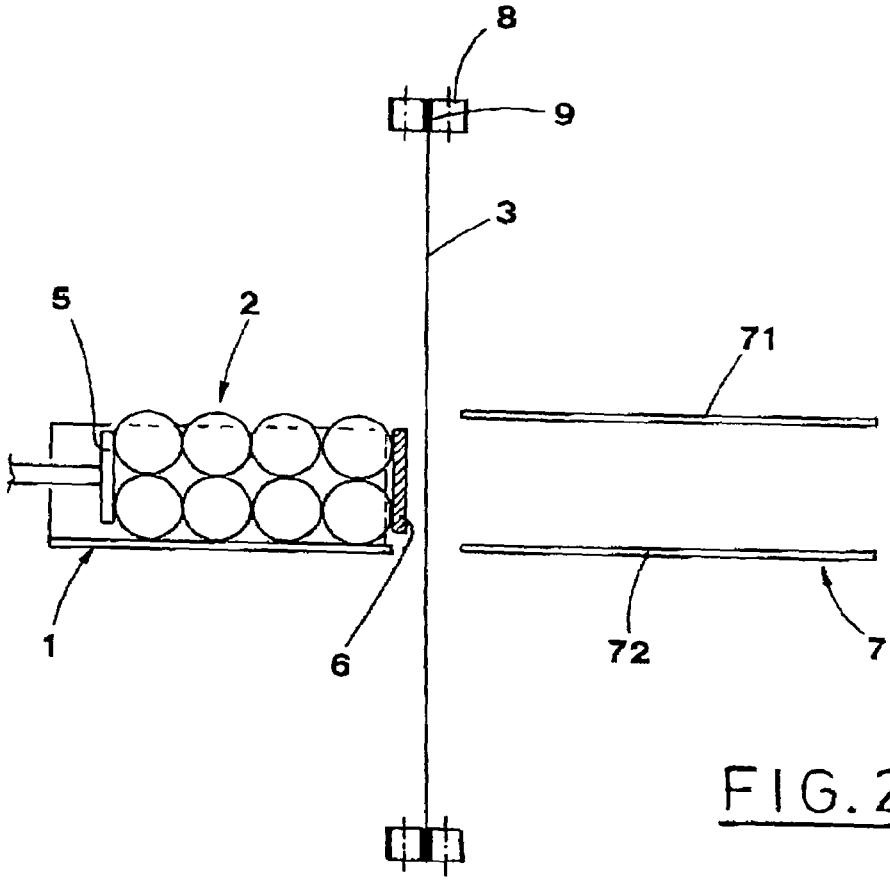
FIGS. 2 and 3 are section views of the apparatus, taken along the planes II—II and III—III in FIG. 1A.

A panel 6, situated beside the initial part of the feeding line 1, acts as a stop supporting the groups of articles 2 inside the spaces defined by the bars 4 (FIG. 2).

The panel 6 extends up to the point, in which the feeding line I is located beside a line 7 for wrapping the groups of articles 2.

The line 7 for wrapping groups of articles 2 extends beside the articles 2 feeding line 1 and wraps the groups of articles 2 with respective packaging sheets, which are preferably constituted by a film of plastic material, e.g. polyethylene, polythene, polypropylene, or another material typically used for packaging.

The wrapping line 7 is formed by a pair of conveying belts 71, 72, arranged one above the other, extending substantially along the entire operative extension of the machine.

Figure 3:
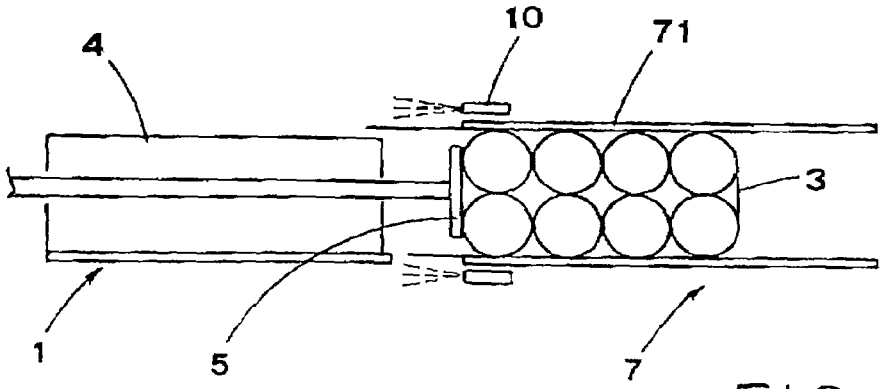

The conveying belts 71, 72, only the active sections of which have been shown in FIGS. 2 and 3, leaving out the return sections thereof, are mounted in a closed loop on the wheels or rolls 70 and are operated in opposite directions, with peripheric speed equal to that of the feeding line 1, so as to define respective opposite runs, which move simultaneously in the forward movement direction A (see FIG. 4).

The sheets 3, perfectly cut from a bobbin of the above mentioned packaging material, are arranged to be kept spread out, by suitable support and movement means 8, on a vertical plane, in an intermediate position between the articles 2 feeding line 1 and the wrapping line 7.

More precisely, the sheets 3 are moved in the forward movement direction A, with a speed equal to the speed of the above mentioned lines 1 and 7, between related pairs of belts 9, situated respectively above and below horizontal planes defined by the conveying belts 71, 72, as it is clearly seen in FIG. 2.

The belts 9 are carried and operated by known turn-around means 8, shown in a schematic way.

Figure 5:
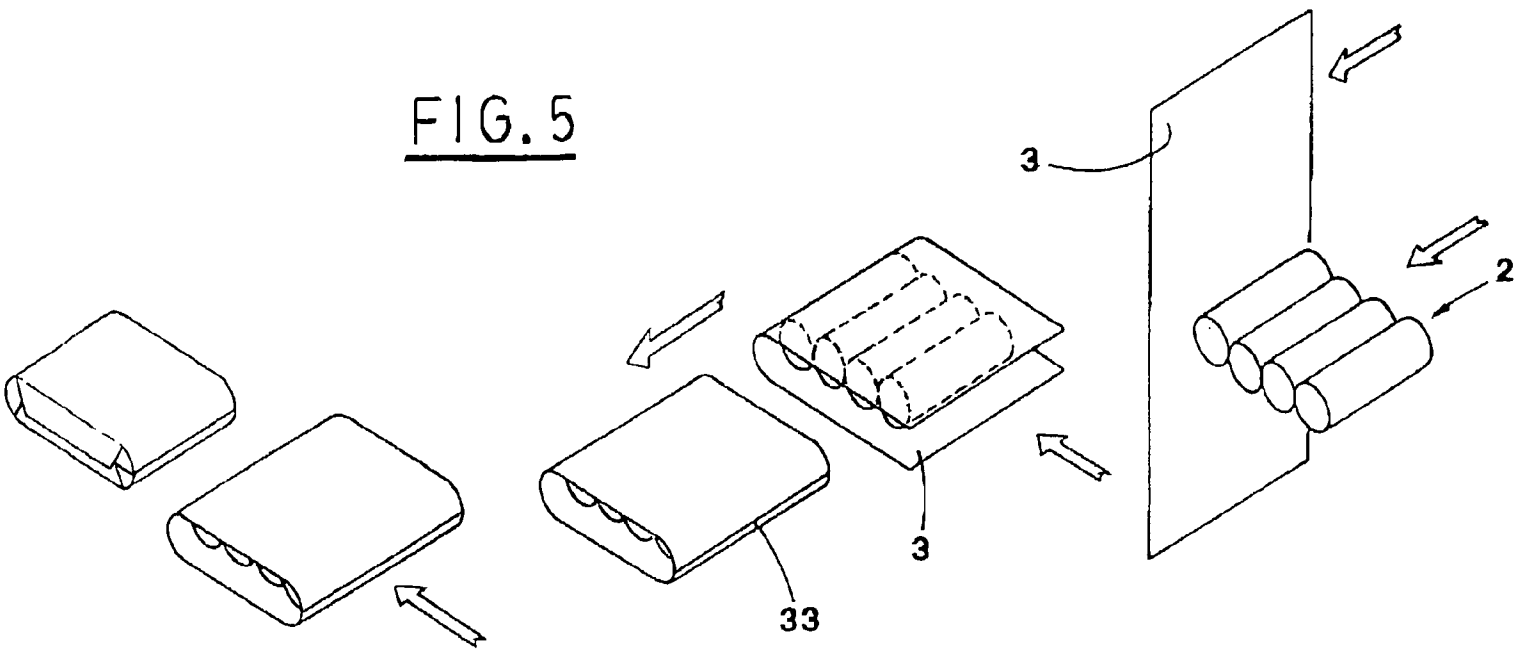
FIG. 5 is a perspective view of a few steps of the wrapping of a group of articles in rolls according the proposed method.

According to the method for wrapping articles 2, proposed by the present invention and shown schematically in FIG. 5, the groups of articles 2 to be packaged are conveyed along the feeding line 1.

According to known techniques, the groups are formed previously between two lateral guides, not shown, and then pushed orderly inside the spaces defined by the bars 4, having their lateral shorter extension turned in the forward movement direction A.

If the articles 2 are e.g rolls of paper, the groups to be packaged are advantageously formed by a series of rolls arranged side by side longitudinally in only one layer or in two layers, put one over the other, and the above mentioned lateral shorter extension coincides with the lateral extension of the rolls arranged side by side.

From this point forward there are no more stops or sudden changes of the forward movement direction, which would require such stops.

The single packaging sheets, arranged on a vertical plane, are moved forward in suitable time relation with the forward movement of the articles 2 along the feeding line 1.

Then, the groups of articles 2 are transferred by the pusher members 5 crosswise to the feeding line 1, as it is clearly shown in FIG. 1A, so that the articles are introduced between the opposite runs of the conveying belts 71, 72 of the wrapping line 7 which is operated with the same speed as the feeding line 1.

During this transferring, the lateral narrowed dimension of the groups of articles 2 hit the packaging sheets 3, so as to fold the latter following the U-shape.

In this way, the sheets 3 wrap the most extended surfaces, i.e. upper and lower, of the groups of articles 2.

During the step of introduction of the groups of articles 2 between the conveying belts 71, 72, blowing means 10 are operated (FIG. 3). The blowing means 10 are aimed at maintaining a spread of the edges of the sheets 3 while being folded.

The groups of articles 2, partially wrapped with the sheets 3, introduced between the conveying belts 71, 72, move forward along the wrapping line 7.

Figure 4A:
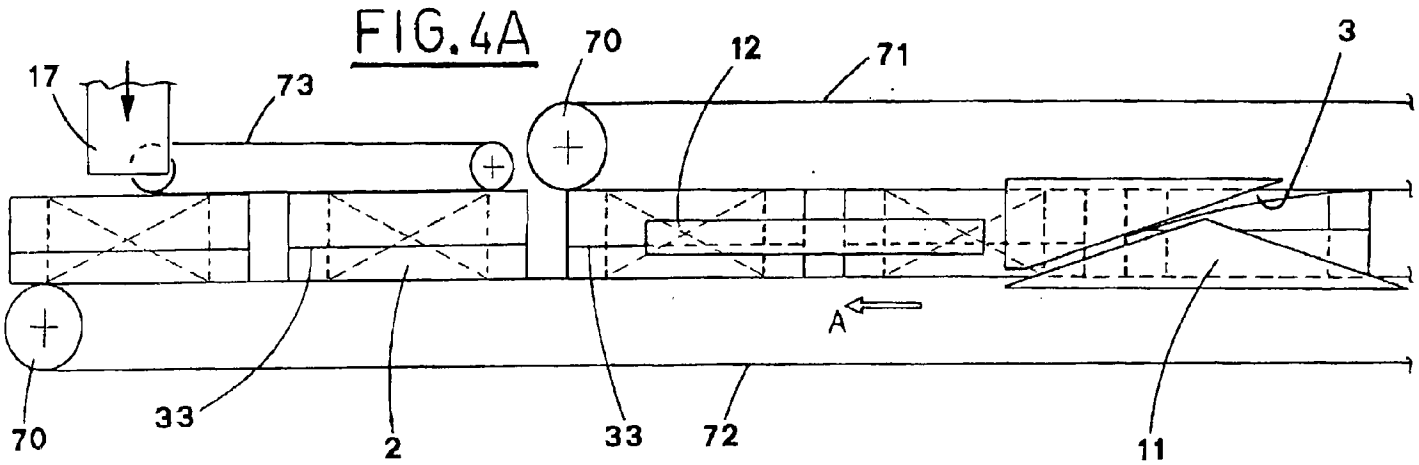
FIG. 4A is a lateral schematic view of the proposed apparatus, from the side indicated with K in FIG. 1B.

During the forward movement along the line 7, the open ends of the folded parts of the sheets 3 meet the stationary folding means 11, suitably shaped, which are aimed at folding the open ends and overlap them, so as to complete the longitudinal wrapping of the groups of articles 2 (FIG. 4A).

Figure 4B:
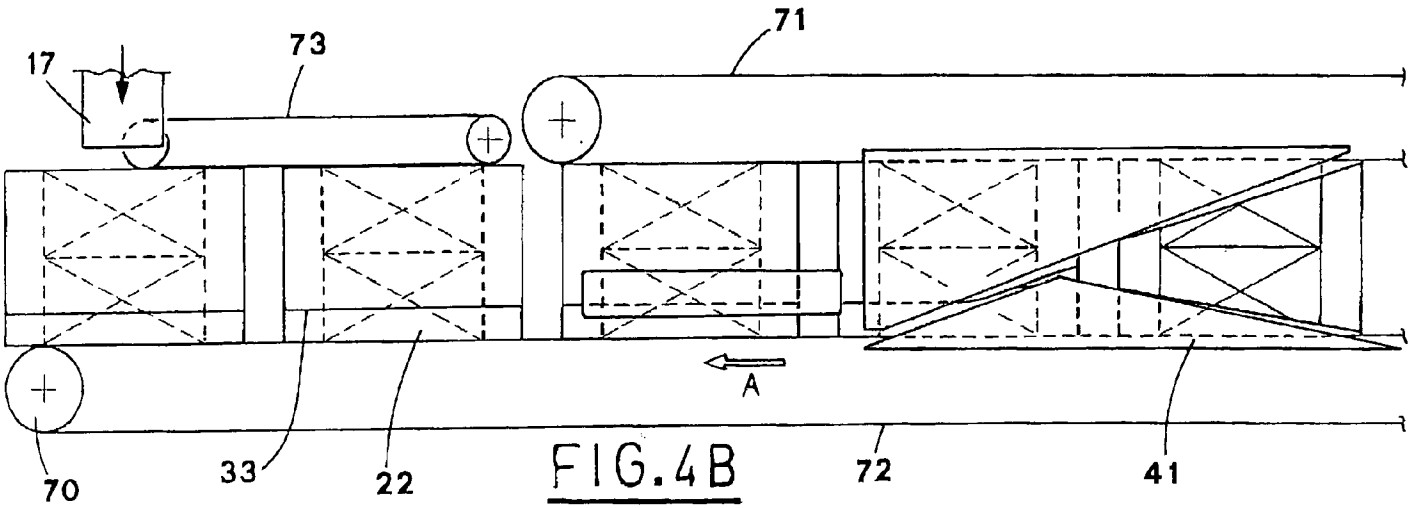
FIG. 4B is a lateral schematic view of the proposed apparatus, from the side indicated with K in FIG. 1B, according to a variation thereof.
Figure 5A:
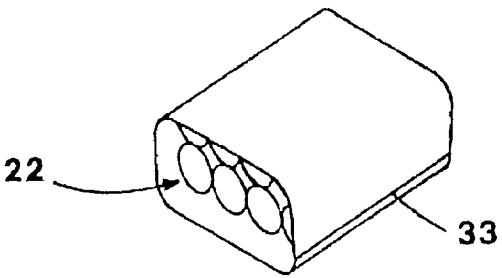
FIG. 5A is a group of articles formed by more layers of articles, e.g. two.

If the packages include two layers of articles arranged one on the other, as shown in FIG. 5A, the distance between the belts 71 and 72 corresponds to the vertical dimension of the packages 22, as shown in FIG. 4B.

The folding members, indicated in this case with 41, have such a shape as to overlap the edges in the region of the center line of the lower layer of articles, or rolls, for the purpose which will become evident later on.

Coming back to the configuration of a single layer of packages (FIG. 4A), the overlapped edges of the folded parts of the packaging sheets 3 are joined by a belt welding member 12 of known type, which acts along the same wrapping line 7, downstream of the folding means 11, in the forward movement direction A.

Therefore, the sheets 3 are welded along the longitudinal side of the groups of articles 2, opposite to the one which hits the sheets 3, having a corresponding narrowed dimension; the welding line 33, indicated in FIG. 4A, is situated more or less in the central area of the narrowed dimension of the package, or shifted a bit with respect thereto.

In case of the two-layer configuration (FIG. 4B), the welding member is situated in such a way that the welding line 33 is situated in the central area of e.g. the lower layer of articles, or shifted a bit with respect thereto.

In this way, the welding member presses the overlapped edges always against the article or articles situated below, and not against an empty area, which is created in the central part of the package side.

At the outlet of the wrapping line 7, the groups of articles 2, wrapped with the packaging sheets 3, closed all around, are subjected to the change of the direction of forward movement of the line 7, without the stops, so as to close the packages in the regions of the opposite heads of the articles 2.

Other folding and welding means, not shown, acting along a line 13 of the packaged articles 2 outlet, close the packages.

Figure 1B:
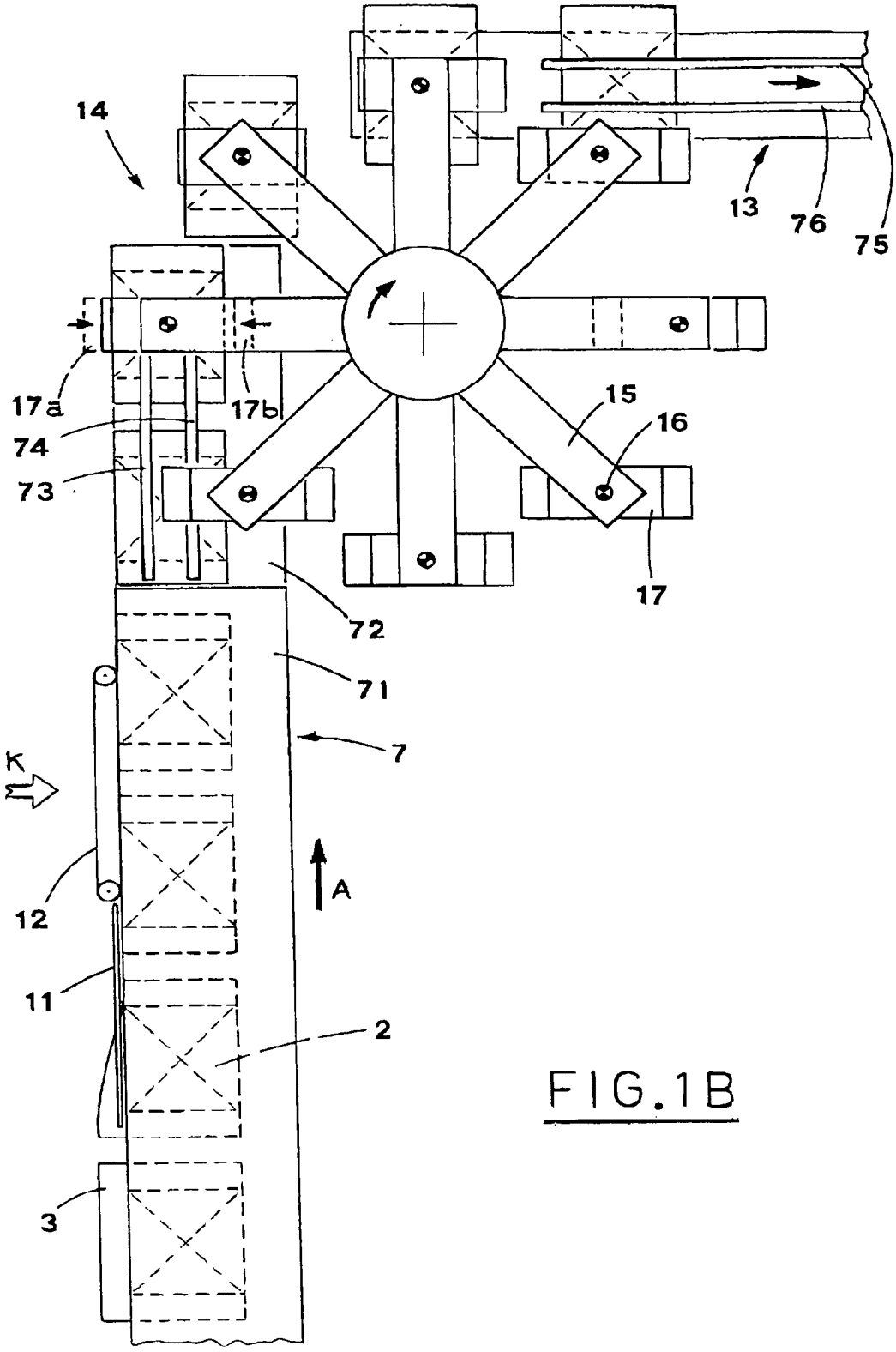
FIG. 1B is another partial top view of the apparatus, taken at the outlet area for the articles being packaged.

The packages are transferred to the line 13 by e.g a transporting device 14, rotating on a vertical axis, seen in FIG. 1B.

The rotating transporting device 14 features a series of radial arms 15, which carry on their free end, pivoted by a pin 16, respective picking up means 17 extending downwards.

The picking up means 17 pick up the groups of articles 2, wrapped with the packaging sheets 3 wrapped all around them, and transfer them orderly to the outlet line 13, maintaining unchanged their orientation due to the simultaneous rotation on the pin 16, in the direction opposite to the rotation of the conveyor 14.

The action of the picking up means 17 is possible due to the fact that the lower conveying belt 72 extends longitudinally beyond the extremity of the upper conveying belt 71, as clearly seen in FIG. 4*a*.

Two or more bands 73, 74 are situated above the terminal part of the conveying belt 72 extending beyond the upper conveying belt 71.

The bands 73, 74 are mounted on corresponding wheels and moved with a peripheric speed equal to the speed of the two conveying belts 71 and 72.

The bands 73 and 74 hold the upperpart of the semi-packaged group of articles by pressing it against the lower conveying belt 72, situated below.

In this way, access to the groups of articles of the upper part is made possible.

The groups of articles 2 below the bands 73, 74 are picked up by two movable parts 17*a*, 17*b* of the picking up means 17, which move close from above and grip the group of articles 2 therebetween.

The rotation of the transporting device 14, performed in phase relation with the movement of the conveying belts 71 and 72, allows the picking up means 17 to pick up the group of articles by withdrawing it from the grasp of the lower conveying belt 72 and the upper bands 73 and 74, in the terminal area of the latter.

After having rotated by 90°, the picking up means 17 release the previously picked up group of articles onto the outlet line 13 and, simultaneously, the package is rotated in the direction opposite to the rotation of the rotating conveyor, so that the package maintains its orientation, although its forward movement direction changes without stopping the movement.

The picking up means 17 release the semi-packaged group of articles in the initial area of upper holding bands 75, 76, similar to the upper bands 73 and 74 and fulfilling the same function.

The flaps of the still open heads of the package are folded and welded together along the outlet line.

Consequently, the method and apparatus according to the present invention achieve the aim of wrapping articles, such as in particular rolls of paper or the like, gathered in packs or groups, within a film in such a way as to leave perfectly free from welding both the most extended surfaces of the packs or groups of packaged articles.

This allows not only a better presentation of the package but also the use of both most extended surfaces to support commercial, advertisement or other kinds of information.

All this is obtained while the products follow a path without sudden trajectory changes nor stops required thereby.

It is to be pointed out that an apparatus of simple structure, functional and extremely versatile, obtains this result.

Actually, in order to adapt the machine to different sizes of the articles 2 and/or packages, it is enough to change the distance between the two belts 71, 72, arranged one over the other, as well as the distance, or step, between the bars 4.

There are no stops or direction changes along the whole path followed by the packages, beginning from forming of the groups of articles.

This allows to simplify in a maximum way the structure of the machine and to facilitate its operation considerably.

In addition to the positive effect on the production and maintenance costs, it is also possible to increase the production rate by eliminating all stops, which are no longer necessary.

While preferred embodiments of the present invention have been shown and described, it will be understood by those skilled in the art that various changes or modifications can be made without varying from the present invention.

What is claimed is:

1. A method for wrapping articles within a packaging sheet, comprising the steps of:

moving groups of articles (2,22) to be packaged horizontally along a feeding line (1), the groups of articles arranged orderly and having a lateral narrow side extension oriented parallel to a forward movement direction (A);

moving single packaging sheets (3) along side of said feeding line (1), in suitable phase relation with the forward movement of said groups of articles (2,22) along said feeding line (1);

transferring said groups of articles (2,22), crosswise with respect to said feeding line (1), so that the groups of articles hit said packaging sheets (3) with said lateral narrow side extension to fold said packaging sheets (3) around said groups of articles (2,22);

joining the folded edges of said packaging sheets (3) along an opposite side of said groups of articles (2,22), which present a corresponding lateral narrow side extension;

transferring the groups of articles (2,22) wrapped respectively with said packaging sheets (3) crosswise to the forward movement direction along said feeding line (1), maintaining unchanged the orientation of the groups of articles (2,22) to close the packages in the region of the opposite ends of said articles (2,22).

2. The method according to claim 1, wherein said packaging sheets (3) are moved while being maintained in a vertical plane longitudinal with respect to said feeding line (1).

3. The method according to claim 1, wherein said packaging sheets (3) are moved forward along side of said feeding line (1), at a speed equal to a speed of the feeding line (1).

4. The method according to claim 1, further comprising transferring said groups of articles (2,22) crosswise to said feeding line (1), so as to hit said packaging sheets (3) in a central section, thus folding said packaging sheets (3) on the most extended surfaces, upper and lower, of said groups of articles (2,22).

5. The method according to claim 1, further comprising providing blowing means (10), for blowing air to maintain a spread of the edges of said packaging sheets (3) while being folded, during the step of transferring of said groups of articles (2,22) crosswise to said feeding line (1).

6. The method according to claim 1, further comprising gripping said groups of articles (2,22) leaving said feeding line (1) on their closed less extended surfaces for transfer to an outlet line (13) without changing their orientation, for folding and welding the edges of the still open less extended surfaces.

* * * * *